United States Patent [19]

Jones

[11] Patent Number: 4,834,688

[45] Date of Patent: May 30, 1989

[54] ARTICLE OF CLOTHING

[76] Inventor: Leonard W. Jones, P.O. Box 339, Mooloolaba, Queensland 4557, Australia

[21] Appl. No.: 206,309

[22] Filed: Jun. 14, 1988

[51] Int. Cl.[4] ..... A41B 1/00; A41B 1/08

[52] U.S. Cl. ..... 446/28; 2/250; 2/249; 2/247; 2/115; 40/586; 446/26

[58] Field of Search ..... 2/247, 248, 249, 250, 2/251, 252; 40/586; 446/26, 27, 28; 150/100

[56] References Cited

U.S. PATENT DOCUMENTS

| | | | |
|---|---|---|---|
| 3,018,486 | 1/1962 | Bukspan | 2/247 |
| 3,085,254 | 4/1963 | Culter | 2/247 |
| 3,777,310 | 12/1973 | Yang | 446/28 X |
| 4,156,293 | 5/1979 | Off | 2/247 |
| 4,266,300 | 5/1981 | Partridge | 2/247 |
| 4,625,337 | 12/1986 | Zahn | 40/586 X |
| 4,710,981 | 12/1987 | Sanchez | 40/586 X |

*Primary Examiner*—Werner H. Schroeder
*Assistant Examiner*—Jeanette E. Chapman
*Attorney, Agent, or Firm*—Hoffman, Wasson, Fallow & Gitler

[57] ABSTRACT

A surface of an article of clothing is provided with a transparent pouch for holding a liquid representative of a beverage. The article has indicia thereon whereby the indicia is visible through the pouch.

21 Claims, 3 Drawing Sheets

ARTICLE OF CLOTHING

The present invention relates to a novelty article having bubble, blister or container with liquid which together with artwork enables the article to function as a novelty item.

BACKGROUND AND SUMMARY OF THE INVENTION

The novelty industry has seen the development of articles of clothing providing with various illustrations and designs. Typically has, T-shirts and trousers have been provides with imprints of eminent people, artwork derived from motion pictures or videos, school names, emblems phrases and advertising logos or the like. These articles had as there primary purpose the provision of illustrations or designs either for advertising or for novelty purposes.

In U.S. Pat. No. 4,120,053 there was disclosed an article of clothing provided with a sheet of material placed in confronting relation with and affixed to an inner surface of the article to form a pocket for holding a number of solid novelty-type objects. An aperture was formed in an outer surface of the article to communicate the outer surface to the pocket and to allow the objects to be despensed from the pocket. The outer surface had an illustrative design that drew the viewer's attention to and suggested the aperture as a dispensing point for the objects.

The illustration was a representation of part of a gum ball machine whilst the pocket formed a facsimile of the transparent dome for the machine. The objects were representative of or were gum balls.

The article disclosed in U.S. Pat. No. 4,120,053 was not suitable for providing a novelty article where liquids rather than solid objects were to be contained in the pocket.

There have been prior proposals for articles of clothing with pockets, bubbles or the like and in which the possibility was provided for having the pockets filled with some substance such as air or a liquid.

In U.S. Pat. No. 4,310,927 a shirt was proposed having a plurality of inflatable chest muscle portions, inflatable stomach muscle portions and inflatable biceps portions. The various portions can be inflated manually by a pump.

In U.S. Pat. No. 4,384,369 an exercise suit was disclosed. The suit had numerous pockets into which discrete bags containing liquids could be inserted to provide a weight load.

U.S. Pat. No. 4,591,521 teaches the use of contoured pads inserted into pockets to highlight an illustrative design. The pockets were not constructed to contain liquid and were formed on the inside surface of a shirt.

U.S. Pat. No. 4,466,136 disclosed a T-shirt having a design with a complimentary object fastened thereto. U.S. Pat. No. 4,627,110 disclosed the use of a plastic writing surface stitched to the front of a T-shirt and made complementary to the design.

None of these earlier patents suggested a novelty article of clothing having permanently secured thereto a pocket, bubble or pouch carrying a liquid and including a design or illustration having an association or relationship to the pocket which gives the article its novelty value.

It is an object of the invention to provide a novelty article having a pouch containing liquid.

It is another object of the invention to provide a novelty article of clothing having a pouch containing liquid.

The invention provides in one aspect an article having a surface bearing indicia and a pouch comprising two superimposed layers of transparent sheet material a peripheral seal extending around an edge periphery of the sheets and securing the sheets to each other, an inner seal spaced inwardly of the peripheral seal and securing the sheets together to define an enclosed space and a liquid at least partially filling the space in the pouch whereby said indicia being visible through the pouch.

The invention provides in another aspect an article of clothing adapted to be worn by a person and having a surface a pouch comprising two superimposed layers of transparent material having a peripheral seal extending around an edge periphery of the sheets and an inner seal spaced inwardly of the peripheral seal and said inner seal securing the sheets together to define an enclosed space, said pouch being secured to the surface between the seals; liquid within the space; and, indicia on the surface whereby said indicia is visible through the pouch.

The invention provides in yet another aspect a T-shirt having a surface, a pouch comprising two superimposed layers of transparent material having a peripheral seal extending around an edge periphery of the sheets and an inner seal spaced inwardly of the peripheral seal and the inner seal securing the sheets together to define an enclosed space, said pouch being secured to the T-shirt between the seals; liquid within the space said liquid including distilled water about 0.5 grams/liter of water of sodium benzoate, about 4 grams citric acid/liter of water, at least one food dye and about 0.15 grams/liter of water of saponin; and, indicia on the T-shirt representative of a beverage container whereby the indicia is visible through the pouch.

BRIEF DESCRIPTION OF THE DRAWINGS

In the accompanying drawings in which is shown one of the various possible exemplary embodiments of the invention.

DESCRIPTION OF THE PREFERRED EMBODIMENT

Figure 1:
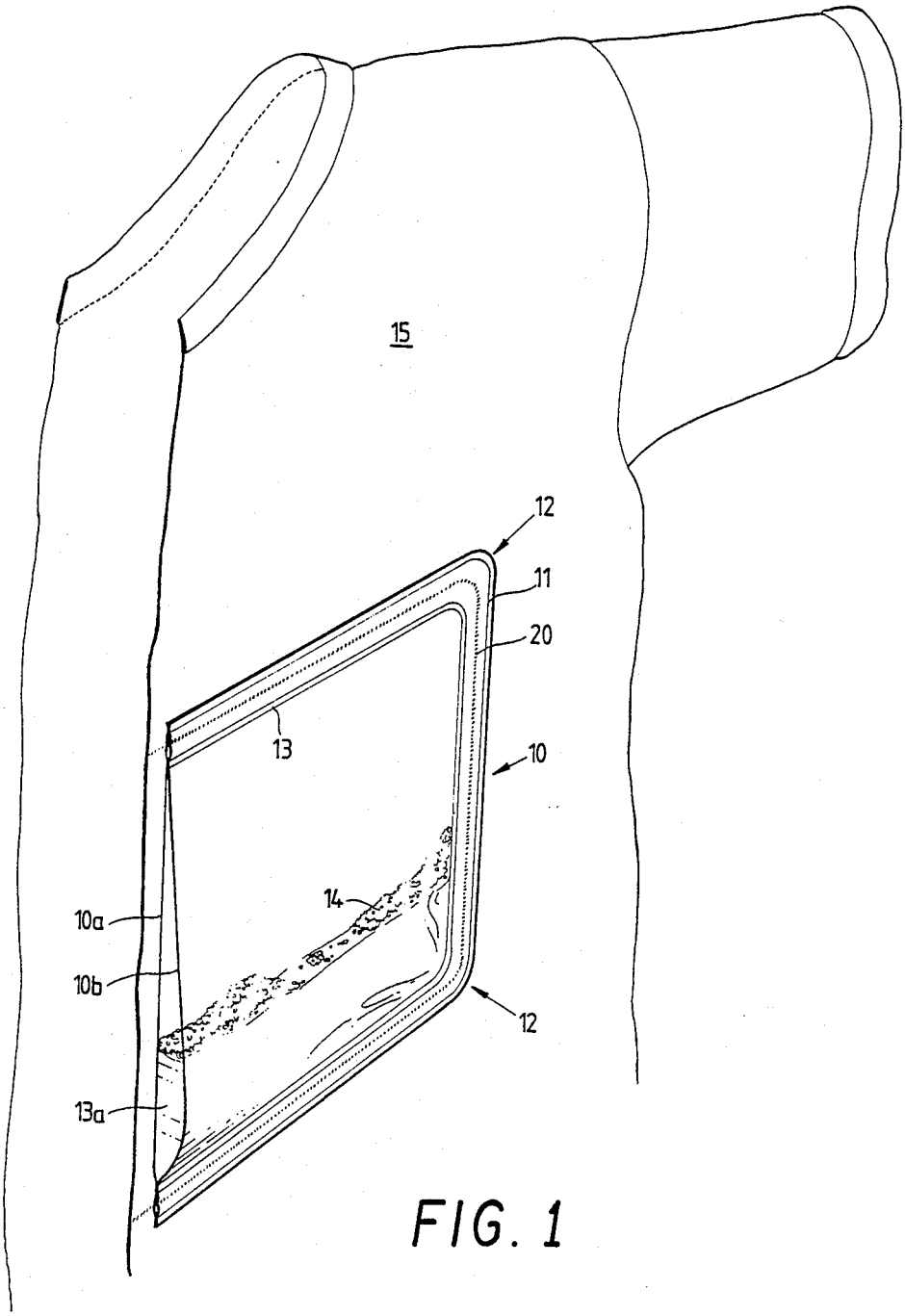
FIG. 1 is a view of a pouch according to an embodiment of the invention.

Referring now in detail to the drawings, the numeral 10 designates generally a pouch, pocket or bubble. Pouch 10 is typically made of clear or translucent plastics material. Plastics material such as PVC UV stabilised and having a thickness of about 0.3 mm is preferred because it results in a pouch of having the desired degree of flexibility, softness and durability to facilitate washing of the T-shirt and to resist rough treatment whilst still being clear enough to view the liquid and any artwork on the T-shirt covered by the pouch 10. The pouch 10 is made of two layers secured to each other to form a periphery seal 11. The layers may be cut from sheet material in any suitable way such as by an electrode. The pouch has rounded corners 12 and the seal 11 may be achieved by bonding the layers to each other using a bonding agent or adhesive. Alternatively, high frequency welding may be used to produce the seal. The seal 11 may be achieved by using a high air gun or a hot bar weld but high frequency welding as preferred.

Inner seal 13 can be produced in a like fashion to seal 11. Seal 13 defines a volume between the layers of the pouch which may be filled with a liquid. The liquid may fill pouch 10 up to a level indicated by ghost outline 14 although other levels may be used.

To manufacture pouch 10 two layers of plastics material are placed in overlapping relationship and seal 13 is produced leaving a small opening through which the liquid and a desired volume of air or other gas is then injected using a pump. Seal 13 is then completed. Seal 11 is then formed and the pouch is ready to be secured to an article of clothing such as a T-shirt.

Figure 2:
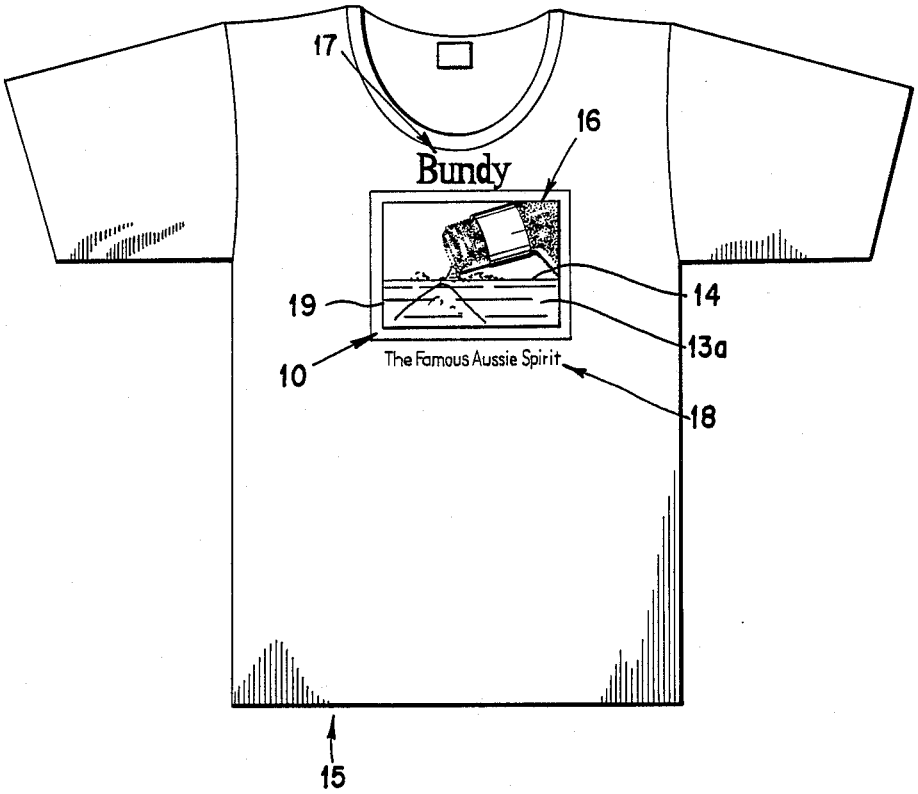
FIG. 2 is a view of a T-shirt having the pouch of FIG. 1 secured thereto.

FIG. 2 shows a T-shirt 15 with a pouch 10 secured thereto. The T-shirt 15 has artwork including a representation of a bottle neck 16, text 17, 18 and the upper portion of a glass 19. Clearly, the artwork may be chosen as desired. Where the artwork is such that the novelty value of the T-shirt requires the liquid in the pouch to be a reasonable facsimile of a beverage, the liquid should be carefully chosen to give the desired effect. For example the liquid should be treated to inhibit or stop the growth of bacteria without bleaching or discolouring the material from which the pouch is made.

The pouch is preferably filled with a non-toxic liquid distilled water with about 0.5 grams sodium benzoate or other mild antioxidant or bacteriacide. Preferably about 4 grams of citric acid per liter or other preservative is also added to the distilled water.

Where it is desired to have the liquid resemble or be a reasonable facsimile of a beverage it is desirable to include in the liquid a suitable dye or dyes. The dye(s) should be chosen so as to not premanently colour the material of the pouch.

The dyes may typically be food dyes such as C.I. constitution no. 16255 (RED), 42090 (BLUE) and 19140 (YELLOW) mixed or otherwise included in the liquid to provide the colour required.

For stimulation of a beverage such as beer for example which many normally have a frothy head a frothing agent such as saponin or substitute or equivalent may be added to the liquid. Saponin or other frothing agent may be added in the amount of about 0.15 grams/liter of liquid.

The pouch 10 can be welded, glued or otherwise attached to the T-shirt. However, if the pouch is to be secured to a T-shirt and that shirt has artistic designs or embellishments on it, it is preferable to sew the pouch onto the shirt. Straight stitching is preferred. Regardless of whether sewing or some other attachment is used, the attachment should occur between the two seals. In this way the integrity of the pouch is not destroyed.

For manufacturing purposes it is conceivable that a supply of T-shirts may be held in stock and pouches may be secured as demand dictates. Where sewing is employed to secure the pouch, the thread should be of a suitable strength although after sewing a broken thread will not easily pull through the pouch material and it is unlikely that the pouch will become separated from the T-shirt.

With reference to FIG. 2 there is shown a T-shirt 15 having artwork consisting of text 17, 18, a pictorial representation of a bottle neck 16 and a glass 19. Pouch 10 with liquid is superimposed over the part of the artwork. The liquid within the pouch, when the pouch is positioned in this way suggest that the glass 19 is partially full. The above description is provided in relation to an article of clothing and in particular a T-shirt. This is by way of example only. Clearly the article may be clothing other than a T-shirt or indeed may not even be an article of clothing at all. For example the article may simply be a textile article or sheet of material.

Figure 3:
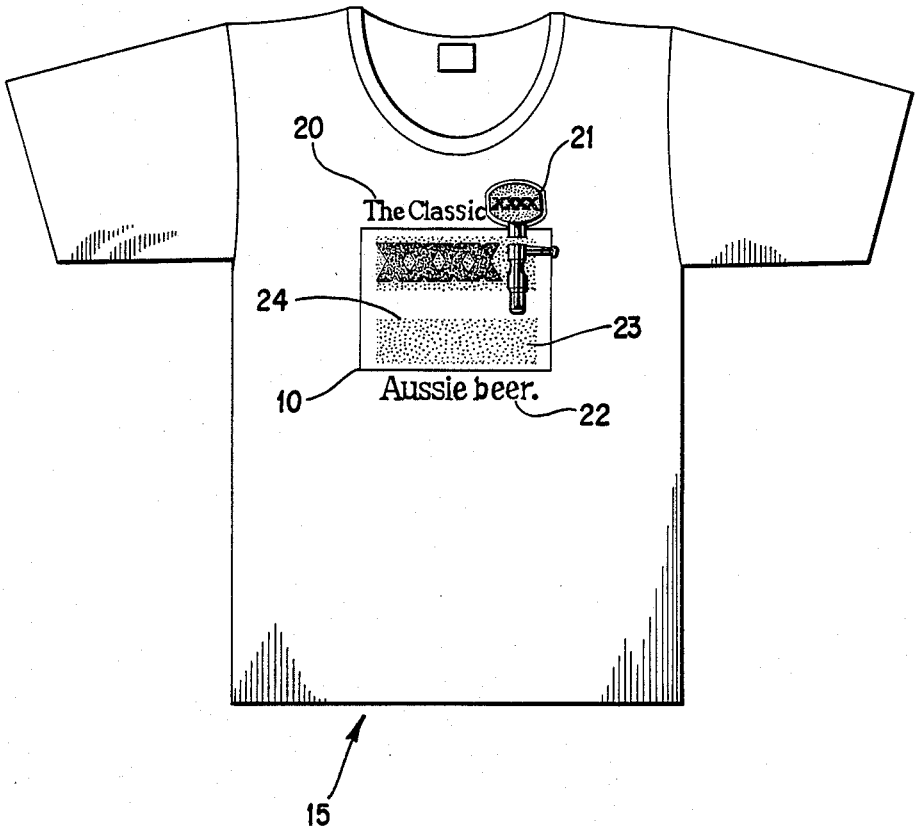
FIG. 3 is an alternative view of a T-shirt to that shown in FIG. 2.

FIG. 3 shows an alternative T-shirt 15 to that shown in FIG. 2. The shirt of FIG. 3. A pouch 10 is shown positioned on shirt 15 relative to indicia 20, 21 and 22. The pouch has liquid 23 up to level 24. Indicia 21 includes a representation of a beer tap and which together with liquid 23 gives the impression of beer having been dispensed from the tap.

Therefore, the above description and illustrations should not be construed as limiting the scope of the invention which is defined in the appended claims.

What I claim is:

1. An article having a surface bearing indicia and a pouch comprising two superimposed layers of transparent sheet material a peripheral seal extending around an edge periphery of the sheets and securing the sheets to each other, an inner seal spaced inwardly of the periphery seal and securing the sheets together to define an enclosed space and a liquid at least partially filling the space in the pouch whereby said indicia being visible through the pouch.

2. The article of claim 1 wherein the indicia is visible through the liquid.

3. The article of claim 1 wherein the pouch is secured to the surface by sewing with stitches being located between the peripheral seal and the inner seal.

4. The article of claim 1 wherein the pouch is secured to the surface by a bonding agent located between the peripheral seal and the inner seal.

5. The article of claim 1 wherein the seals are formed by a bonding agent.

6. The article of claim 1 wherein the seals are formed by high frequency welding.

7. The article of claim 1 wherein the seals are formed by heat welding.

8. The article of claim 1 wherein the liquid includes distilled water, a bacteriacide and one or more dyes.

9. The article of claim 8 wherein the liquid includes a preservative.

10. The article of claim 9 wherein the bacteriacide is sodium benzoate in the proportion of about 0.5 grams/-liter of water.

11. The article of claim 9 wherein the water includes about 4 grams/liter citric acid.

12. The article of claim 8 wherein the water includes a foaming agent.

13. The article of claim 12 wherein the foaming agent is saponin in the proportion of about 0.15 grams/liter of water.

14. The article of claim 8 wherein the liquid includes at least one dye.

15. The article of claim 1 wherein the liquid is representative of beer.

16. An article of clothing adapted to be worn by a person and having a surface a pouch comprising two superimposed layers of transparent material having a peripheral seal extending around an edge periphery of the sheets and an inner seal spaced inwardly of the peripheral seal and said inner seal securing the sheets together to define an enclosed space, said pouch being secured to the surface between the seals;

liquid within the space; and, indicia on the surface whereby said indicia is visible through the pouch.

17. The article of clothing of claim 16 wherein the article is a T-shirt.

18. The article of claim 17 wherein the indicia includes a representation of a beverage container and the liquid is representative of a beverage.

19. The article of claim 18 wherein the liquid is representative of beer.

20. A T-shirt having a surface a pouch comprising two superimposed layers of transparent material having a peripheral seal extending around an edge periphery of the sheets and an inner seal spaced inwardly of the peripheral seal and the iner seal securing the sheets together to define an enclosed space, said pouch being secured to the T-shirt between the seals; liquid within the space said liquid including distilled water, about 0.5 grams/liter of water of sodium benzoate, about 4 grams citric acid per liter of water, at least one food dye and about 0.15 grams/liter of water of saponin; and, indicia on the T-shirt representative of a beverage container whereby the indicia is visible through the pouch.

21. The T-shirt of claim 20 wherein the liquid is representative of beer.

* * * * *